United States Patent [19]

Christiansen

[11] 3,938,949

[45] Feb. 17, 1976

[54] METHOD AND APPARATUS FOR BURNING PULVERULENT MATERIALS

[75] Inventor: Soren Bent Christiansen, Copenhagen Valby, Denmark

[73] Assignee: F. L. Smidth & Co., Cresskill, N.J.

[22] Filed: July 24, 1974

[21] Appl. No.: 491,620

[30] Foreign Application Priority Data

July 31, 1973 United Kingdom ..... 36378/73

[52] U.S. Cl. ..... 432/14; 432/78; 432/80; 432/106

[51] Int. Cl.[2] ..... F27B 15/16

[58] Field of Search ..... 432/14, 80, 78, 106

[56] References Cited

UNITED STATES PATENTS

| | | | |
|---|---|---|---|
| 1,468,168 | 9/1923 | Pike | 432/106 |
| 2,218,476 | 10/1940 | Newhouse | 432/80 |
| 2,283,129 | 5/1942 | Roubal | 432/80 |
| 3,834,860 | 9/1974 | Fukuda | 432/106 |

*Primary Examiner*—John J. Camby
*Attorney, Agent, or Firm*—Pennie & Edmonds

[57] ABSTRACT

A method and apparatus is disclosed for burning pulverous or granular material, particularly cement raw material to cement clinker. Burning of the pulverous material is accomplished in a plant which includes a suspension preheater, a rotary kiln and a separate rotary cooler unit having an inlet end and an outlet end, for cooling the burnt material exiting from the kiln by means of air which is subsequently used for combustion and preheating purposes. The method comprises dividing the heated cooling air into at least two streams, directing the divided heat cooling air out of both ends of the rotary cooler unit in its divided streams, directing at least one stream to the rotary kiln to be used as combustion air, directing exhaust gases from the rotary kiln to the preheater to preheat the material, and directing the other stream of heated cooling air to the preheater to preheat the material prior to being burnt in the rotary kiln.

25 Claims, 1 Drawing Figure

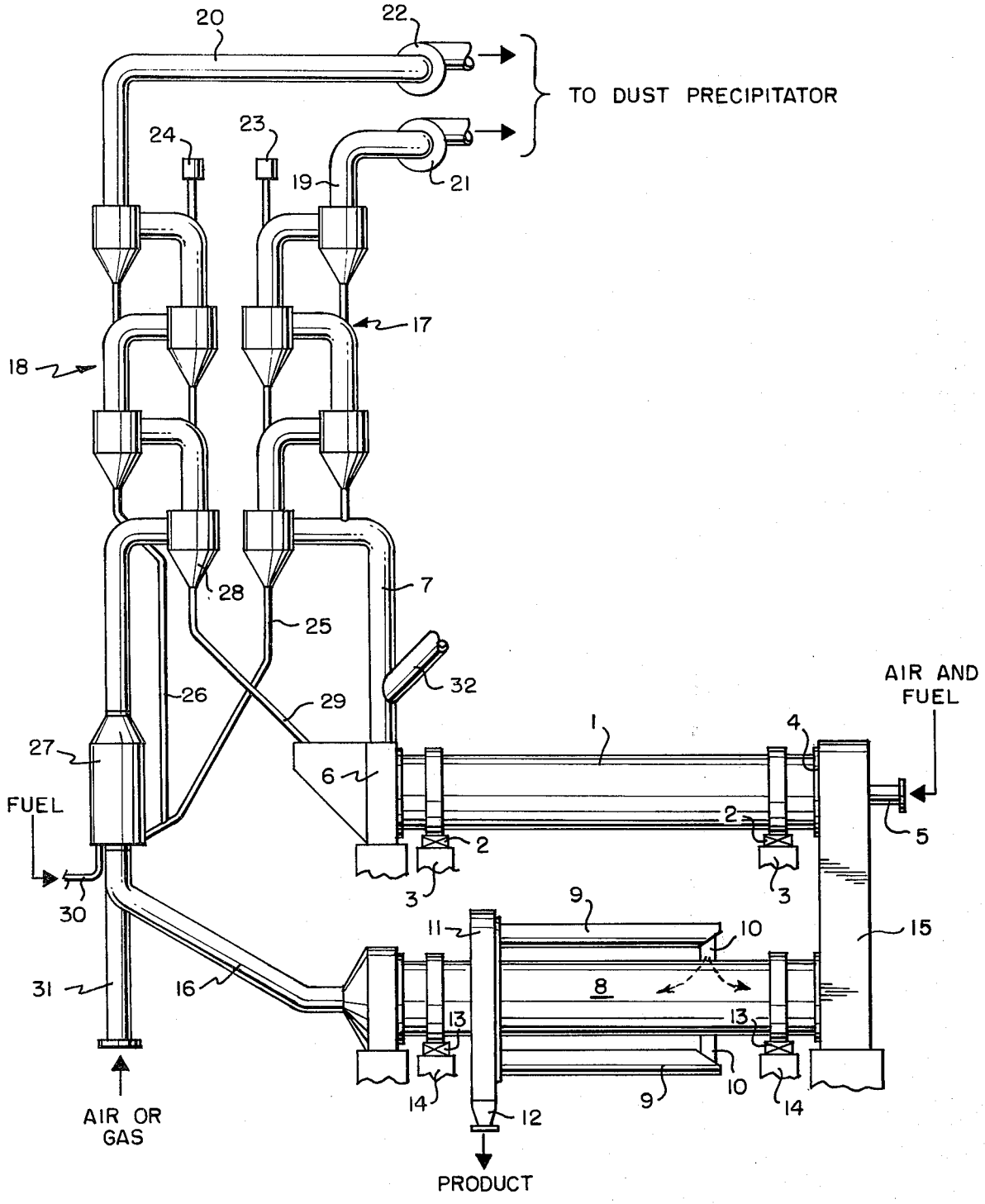
20
22
TO DUST PRECIPITATOR
24
23
19
21
17
18
28
7
25
32
26
29
AIR AND FUEL
1
4
27
6
FUEL
2
5
2
3
3
30
9
11
10
15
31
16
8
13
13
14
9
10
14
12
AIR OR GAS
PRODUCT

METHOD AND APPARATUS FOR BURNING PULVERULENT MATERIALS

BACKGROUND OF THE INVENTION

1. Field of the Invention

The invention relates to improvements in burning pulverous or granular materials. More particularly the invention pertains to such improvements in burning cement raw meal to cement clinker.

2. Description of the Prior Art

In the past several attempts have been made to increase the efficiency of the operation of rotary kiln plants of the type contemplated. For example, the kiln products are generally cooled at least to a temperature low enough to allow for further treatment such as grinding, storage, etc., of the product. It has been known that the greater the amount of heat energy which is recovered from this cooling process, the greater will be the efficiency of the plant. However, by known methods and plants, it has been extremely difficult to recover sufficient amounts of heat from the cooling process of hot kiln products.

When the hot product is cooled in grate coolers, part of the heated cooling air discharged from the cooler may be utilized as combustion air in the rotary kiln. Alternately, the cooling air may be divided into two streams, one of which is used for combustion in the rotary kiln, the other being used for preheating purposes in the preheater. However, usually, only part of the heated cooling air from a grate cooler can be used for combustion and preheating purposes in the kiln plant and the remainder of the heated cooling air, having a relatively low temperature, cannot be utilized in a manner which will render the process advantageous. Thus, this cooling air is generally passed to waste. Consequently there is a loss of heat energy and, in addition, the creation of a dust problem, because the heated cooling air generally contains large quantities of dust. Thus that part of the burnt product may be wasted in the form of dust.

In plants in which all the heated cooling air is passed to the rotary kiln as combustion air, these problems have been somewhat eliminated by the introduction of well-known planetary coolers. In planetary coolers - which may be integrally mounted with the rotary kiln - an efficient cooling of the hot product is achieved by means of air drawn through the cooler tubes and by subsequently drawing the air through the kiln.

Attempts have been made to utilize a separate rotary cooler unit of a type having a rotatable inclined tube, with or without associated planetary cooler tubes to improve the cooling effect of the unit. However, in certain circumstances it is difficult to arrange the correct amounts of cooling air subsequently used as combustion air in the burning process performed in the rotary kiln; particularly when an intensive preheating or partial calcining of the product is performed in the preheater. For example, this is the case in rotary kiln plants having a stationary burning chamber or calcining unit within the preheater for precalcination of the raw material. I have invented a method and apparatus which makes it possible to recover substantially increased quantities of heat in such installations.

SUMMARY

A method of burning pulverous or granular materials in a plant having a suspension preheater, a rotary kiln and a separate rotary cooler unit having an inlet and an outlet end, for cooling the burnt material by means of air subsequently used for combustion and preheating purposes in the plant. The method comprises dividing the heated cooling air into two streams, and passing the divided heated cooling air out of both ends of the rotary cooler unit in its divided streams, passing at least one stream to the rotary kiln to be used as combustion air, passing exhaust (or waste) gas from the rotary kiln to the preheater to preheat the material and passing the other stream to the preheater to preheat the material before it is burnt in the rotary kiln.

By thus dividing the heated cooling air into two streams the stream of heated cooling air passed to the rotary kiln may be adjusted in the rotary kiln. Furthermore, by limiting the amounts of air passed (in countercurrent to the product discharged from the kiln) to the cooler this passage of the product is facilitated, and the amount of dust carried along with the heated cooling air is reduced. Because large amounts of dust adversely influence the burning process in the rotary kiln, it can be seen that this feature provides a substantial improvement over the prior art.

The remainder of the heated cooling air is used in the preheater, together with the waste gases from the rotary kiln, such that the heat content of the heated cooling air and the waste gas is recovered as far as possible in the heat exchange process performed in the suspension preheater.

In a preferred embodiment of the invention, the raw material treated in the preheater is partly calcined or burnt by means of fuel introduced into the suspension preheater or a part thereof.

Particularly when burning cement raw material to cement clinker it may be advantageous to divide the process so that calcining of the product is, to a high degree, performed outside the rotary kiln. In this case, the heated air stream from the cooler serves excellently as preheated combustion air for the initial burning in the suspension preheater and the heat content is thereby used in the process. Furthermore, dust problems are largely avoided because the gas resulting from the calcination process together with the combustion gas from the rotary kiln, is cleaned in the dust precipitator of the preheater after having taken part in the process of preheating the cold material fed to the suspension preheater.

In another embodiment of the invention fuel is introduced into the suspension preheater, or part thereof, and the stream of heated cooling air from the rotary cooler unit to the preheater is passed through a separate part of the suspension preheater which is a stationary combustion chamber in which the preheated material is partly calcined or burnt before being fed to the rotary kiln.

Particularly in plants designed for large rates of production it is advantageous to keep the two gas streams (i.e. the exhaust gas stream from the rotary kiln and the combustion gas stream from the stationary combustion chamber) separate in their passage through the suspension preheater until they have been cooled down by heat exchange with the cold raw material fed to the preheater. When the gases have reached a reasonably low temperature in the suspension preheater, a control of the passages for the gas streams may be established so that a preferred division of the streams through the cooler may be effected. The gas streams may thereafter be united and subsequently fed to a dust precipitator for cleaning.

The invention also pertains to a rotary kiln plant for burning pulverous or granular material, the plant comprising a suspension preheater, an inclined rotary kiln and a separate rotary cooler, the rotary cooler being connected at one end by a duct or ducts to the lower end of the rotary kiln and at the other end to the suspension preheater. The invention further comprises means for directing heated cooling air to the rotary cooler in a manner such that the heated cooling air from the rotary cooler is divided into two streams and passed to the rotary kiln in the form of a first stream which serves as preheated combustion air and to the preheater as a separate or second stream. The rotary kiln has means associated therewith for supplying the hot product to the rotary cooler. By arranging the rotary kiln and the cooler as two separate rotatable units several advantages are clearly obtained. The foundations and the bearing rollers may be of moderate sizes and the kiln and the cooler may be driven by separate equipment at speeds independent of each other, such that the speeds of the units may be chosen and controlled to suit immediate needs determined by the processes performed in the kiln and in the cooler respectively.

Although the separate rotary cooler has an excellent cooling performance, it has hitherto given rise to difficulties in the chute through which the burnt product passes to the cooler and through which the heated cooling air passes to the rotary kiln. A major reason for this difficulty is that this passage is narrow and as a result, the air entrains large quantities of dust which may have a harmful influence on the operation of the kiln. Further, the dust may stick to the walls of the chute and form coatings which decrease the cross-sectional area and increase the difficulties.

However these nuisances can be largely eliminated in the plant constructed according to the present invention because part of the heated cooling air may be passed to the preheater through the duct connecting the other end of the rotary cooler with the suspension preheater and only a limited amount of heated cooling air is passed to the kiln.

An important feature of the invention is that the suspension preheater may include a stationary combustion chamber for partly calcining or burning the preheated material before being fed to the rotary kiln. The provision of a stationary combustion chamber in combination with the preheater ensures that the heated cooling air stream, which is passed to the preheater, may be used for partly calcining or burning the preheated raw material before a final burning or sintering is carried out in the rotary kiln. Thus part of the calcining or burning process may be removed from the rotary kiln proper. This in turn reduces the amount of heated cooling air required for combustion in the rotary kiln. The rotary kiln may therefore be of reduced dimensions when compared with conventional rotary kilns of corresponding production capacities.

The rotary kiln may be mounted above the rotary cooler in such a manner that the central tube of the cooler serves as a gas duct for the stream of heated cooling air which is passed to the preheater or the combustion chamber.

When the rotary cooler is of the type having a central tube with planetary cooler tubes, the central tube may function as an air duct for the heated cooling air passed to the preheater. The central tube may thus be kept clean by its rotation. This eliminates the need for long stationary ducts, which are generally difficult to clean and to keep clean.

The central tube may be provided with means such as helical strips mounted on the inner surface of the tube and serving as transport means for returning any dust carried along with the heated cooling air stream passing to the suspension preheater or the combustion chamber. Also the preheater may be divided, in respect of the gas passage, into two units having means for individually regulating the divided heating cooling air streams through the rotary cooler.

The division of the suspension preheater into two separate units, of which one is adapted to be fed by the combustion gases from the rotary kiln and the other by the heated cooling air from the rotary cooler and the secondary combustion chamber, is advantageous because the gas streams may thus be controlled individually, preferably by automatic equipment. This control is preferably located at or near the gas exit end of the suspension preheater where the temperature is normally so low that ordinary flow control means, such as valves and the like, may be used without any risk of damage to the equipment due to overheating.

The construction of a plant according to the invention is also applicable and is of certain interest in connection with modernization of older cement manufacturing plants having long rotary kilns with integral planetary coolers. Such long kilns may be divided into two parts of which the part with the planetary cooler may be used as the separate rotary cooler unit having a central tube with planetary coolers, whereas the remaining part of the rotary kiln then constitutes a short sintering kiln which, together with the separate rotary cooler, is combined with a suspension preheater. The preheater may include, for example, a stationary burning chamber.

It can be seen that a significant feature of the present invention resides in the extremely effective control placed upon the heated cooling air stream which passes to the rotary kiln.

BRIEF DESCRIPTION OF THE DRAWING

Preferred embodiments of the invention are described hereinbelow with reference to the sole drawing which illustrates in side elevation, a plant constructed according to the present invention.

DETAILED DESCRIPTION OF THE PREFERRED EMBODIMENTS

The plant illustrating the principles of the present invention comprises a rotary kiln, a separate rotary cooler, and a suspension preheater with a stationary burning chamber. Referring to the drawing, there is shown a rotary kiln 1 carried by bearing rollers 2 supported by foundations 3. The rotary kiln 1 has a discharge end 4 for discharge of hot burnt material and for inlet of combustion air and fuel to be supplied through a burner pipe 5. The rotary kiln 1 has an inlet chamber 6 for the material to be burnt and for discharge of the combustion gases through a duct 7.

A rotary tube 8 has planetary cooler tubes 9 communicating therewith via chutes 10 and have a common stationary casing 11 for the supply of cooling air. The casing 11 is equipped with a discharge 12 for receiving the cooled product from the cooler tubes. The rotary tube 8 is likewise carried by bearing rollers 13 supported by foundations 14. The rotary tube 8 and the rotary kiln 1 are connected by a communicating chute 15. In addition, the rotary tube is also connected to a discharge duct 16 for discharge of heated cooling air. The ducts 7 and 16 lead to a suspension preheater comprising two separate units 17 and 18 of a known type which comprises a number of cyclones. The units have gas discharge ducts 19 and 20, which via adjustable fans 21 and 22 respectively, lead to a dust precipitator. The dust precipitator is not shown in the drawing. The units have material inlet pipes 23 and 24 and material discharge pipes 25 and 26.

Between the rotary cooler 8 and the preheater unit 18 there is a stationary combustion chamber 27 with a separator cyclone 28 having a material discharge pipe 29 leading to the inlet chamber 6 of the rotary kiln. The stationary combustion chamber 27 is provided with a fuel inlet pipe 30 and an air or gas inlet pipe 31.

The gas duct 7 for discharge of the combustion gases from the rotary kiln has a by-pass 32 for by-passing the preheater during starting up and for continuously by-passing a small part of the gas in order to remove alkalies from the plant and thus to prevent caking on the walls of the plant apparatus.

The cold material to be heat treated in the plant — in this example cement raw material — is fed to the plant through the feed pipes 23 and 24, and fuel for the burning is added through the burner arrangement 5 and the fuel pipe 30.

The burnt material is discharged through the casing 11 having a bottom outlet 12, and the cold atmospheric air is drawn from there through the planetary cooler pipes 9. One part of the air passes in succession through the rotary tube 8, the rotary kiln 1 and the preheater unit 17 and out via the exhaust fan 21.

On its way through the preheater units, the cold raw material is preheated by heat exchange with the hot gas flowing upwards in the preheater units. The preheated raw material leaves the preheater units at their bottom and is fed to the combustion chamber 27 through the discharge pipes 25 and 26.

In the stationary combustion chamber 27 additional heat is introduced and the temperature of the raw material is raised to its temperature of dissociation so that an almost complete calcination of the material takes place in a process in which the heat content of the heated cooling air from the rotary cooler is also utilized. The calcined or partly calcined product is transported to the separator cyclone 28 by means of the gas stream through the stationary burning chamber. The product is separated off in the cyclone 28 and fed to the rotary kiln 1 through the pipe 29.

The calcined material is sintered in the rotary kiln 1 by means of heat developed by the fuel to the kiln through the burner arrangement 5. The burnt hot product is discharged from the kiln through the end opening 4 and falls through the duct 15 into the central tube of the separate rotary cooler unit. The hot product is distributed through the chutes 10 into the planetary cooler tubes 9, in which it is cooled by means of cold atmospheric air drawn through the cooler tubes from the casing 11. The cooled product is discharged at 12.

The cooling air used for cooling the hot product passes into the central tube of the rotary cooler unit 8, in which it is divided into two streams passing in opposite directions as indicated by the arrows.

One stream of the heated cooling air flows through the duct 15 to the rotary kiln to be used as combustion air in amounts adjusted by the speed of the fan 21 to suit the burning process performed in the rotary kiln. The remainder of the heated cooling air passes through the central tube 8 of the cooler unit to serve as combustion air for the calcining process performed in the stationary burning chamber 27 to which it is directed via duct 16.

This division of the burning process ensures that only limited amounts of combustion air have to pass up through the duct 15 in countercurrent to the hot material so that this air will not interfere - to any appreciable extent - with the passage of the hot product downwards to the cooler unit.

A number of modifications may be introduced without departing from the invention. For example, the combustion chamber for partly calcining or burning the material preheated in the suspension preheater before it is fed to the rotary kiln, may be constructed as a part of the rotary cooler. The combination of the rotary cooler and the combustion chamber will simplify the plant. Furthermore, the rotation of the combustion chamber with the rotary cooler implies that an intimate mixing of the fuel and the preheated product may be accomplished so that the initial heat treatment of the product is improved.

I claim:

1. A method of burning pulverous or granular material in a plant including a suspension preheater, a rotary kiln and a separate rotary cooler unit, said cooler unit having a central cooler tube provided with a plurality of cooler tubes arranged in planetary fashion about the central cooler tube, the kiln having an inlet end portion and an outlet end portion for cooling the burnt material by means of air subsequently used for combustion and preheating purposes in the plant, which comprises directing cooling air into the planetary cooler tubes and from the planetary cooler tubes into the central cooler tube, dividing the heated cooling air into at least two streams within the central cooler tube, directing the divided heated cooling air out of both ends of the rotary cooler unit in its divided streams, directing at least one stream to the rotary kiln to be used as combustion air, directing exhaust gases from the rotary kiln to the preheater to preheat the material, and directing the other stream of heated cooling air to the preheater to preheat the material prior to being burnt in the rotary kiln.

2. The method according to claim 1 further comprising introducing a fuel into the suspension preheater or a part thereof to at least partially burn the material prior to feeding it into the rotary kiln.

3. The method according to claim 2 further comprising directing the stream of heated cooling air from the rotary cooling unit to the preheater and passing said stream through a stationary combustion chamber comprising a part of a first section of the suspension preheater, at least partially burning the preheated material before feeding said material to the rotary kiln, and feeding the waste gases from the rotary kiln to a second section of the preheater.

4. A rotary kiln plant for burning pulverous or granular material comprising a suspension preheater, an inclined rotary kiln and a separate rotary cooler, the rotary cooler having a central cooler tube provided with a plurality of cooler tubes arranged in planetary fashion about the central cooler tube and being connected at one end by at least one duct to the lower end of the rotary kiln and communicating at the other end portion with the suspension preheater, means for directing cooling air to the planetary cooler tubes and from the planetary cooler tubes to the central cooler tube in such a manner that the heated cooling air from said rotary cooler is divided into two streams, means for directing a first stream of said preheated cooling air to the rotary kiln for use as preheated combustion air, means for directing the second stream to the suspension preheater for preheating the material to be burnt in the kiln, and means associated with the rotary kiln for directing the hot product from the kiln to the rotary cooler.

5. The rotary kiln plant according to claim 4 further comprising means for directing the material burnt in the rotary kiln from the kiln to the cooler unit and for directing heated cooling air from the cooler unit to the kiln in countercurrent flow.

6. The rotary kiln plant according to claim 4 further comprising means for directing the material burnt in the rotary kiln from the kiln to the cooler unit and for directing heated cooling air from the cooler unit to the kiln in countercurrent flow.

7. The rotary kiln plant according to claim 4 wherein the preheater further comprises a stationary combustion chamber for at least partially burning the preheated material prior to feeding it to the rotary kiln.

8. The rotary kiln plant according to claim 4 wherein the preheater further comprises a stationary combustion chamber for at least partially burning the preheated material prior to feeding it to the rotary kiln.

9. The rotary kiln plant according to claim 5 wherein the preheater further comprises a stationary combustion chamber for at least partially burning the preheated material prior to feeding it into the rotary kiln.

10. The rotary kiln plant according to claim 6 wherein the preheater further comprises a stationary combustion chamber for at least partially burning the preheated material prior to feeding it to the rotary kiln.

11. The rotary kiln plant according to claim 4 further comprising means for mounting the rotary kiln above the rotary cooler unit and means for directing a stream of heater cooling air to at least one of the preheater and combustion chamber.

12. The rotary kiln plant according to claim 8 further comprising means for mounting the rotary kiln above the rotary cooler unit and means for directing a stream of heater cooling air to at least one of the preheater and combustion chamber.

13. The rotary kiln plant according to claim 9 further comprising means for mounting the rotary kiln above the rotary cooler unit and means for directing a stream of heater cooling air to at least one of the preheater and combustion chamber.

14. The rotary kiln plant according to claim 10 further comprising means for mounting the rotary kiln above the rotary cooler unit and means for directing a stream of heater cooling air to at least one of the preheater and combustion chamber.

15. The rotary kiln plant according to claim 4 wherein said preheater is divided for gas passage therethrough into two units having means for individually regulating the divided heated cooling air streams through the rotary cooler and through the divided preheater.

16. The rotary kiln plant according to claim 4 wherein said preheater is divided for gas passage therethrough into two units having means for individually regulating the divided heated cooling air stream through the rotary cooler and through the divided preheater.

17. The rotary kiln plant according to claim 5 wherein said preheater is divided for gas passage therethrough into two units having means for individually regulating the divided heated cooling air streams through the rotary cooler and through the divided preheater.

18. The rotary kiln plant according to claim 7 wherein said preheater is divided for gas passage therethrough into two units having means for individually regulating the divided heated cooling air streams through the rotary cooler and through the divided preheater.

19. The rotary kiln plant according to claim 11 wherein said preheater is divided for gas passage therethrough into two units having means for individually regulating the divided heated cooling air streams through the rotary cooler and through the divided preheater.

20. The rotary kiln plant according to claim 7 wherein said rotary cooler communicates with the suspension preheater by a duct means connected to said other end portion of said cooler and to said stationary combustion chamber.

21. The rotary kiln plant according to claim 8 wherein said rotary cooler communicates with the suspension preheater by a duct means connected to said other end portion of said cooler and to said stationary combustion chamber.

22. The rotary kiln plant according to claim 9 wherein said rotary cooler communicates with the suspension preheater by a duct means connected to said other end portion of said cooler and to said stationary combustion chamber.

23. The rotary kiln plant according to claim 10 wherein said rotary cooler communicates with the suspension preheater by a duct means connected to said other end portion of said cooler and to said stationary combustion chamber.

24. A rotary kiln plant for burning pulverous or granular raw material comprising a suspension preheater, an inclined rotary kiln and a separate rotary cooler unit, the rotary cooler unit having a central cooler tube provided with a plurality of cooler tubes arranged in planetary fashion about the central cooler tube and being connected at one end by at least one duct to the material output end portion of the rotary kiln and communicating at the other end with the suspension preheater, the cooler unit further being connected to a stationary combustion chamber for at least partially burning the raw material prior to feeding it into the suspension preheater, means for directing cooling air to the planetary cooler tubes and from the planetary cooler tubes to the central cooler tube in a manner such that the heated cooling air from said rotary cooler is divided into two streams, means for directing a first stream of said preheated cooling air to the rotary kiln as preheated combustion air, means for directing the second stream of preheated cooling air to the preheater, and means associated with the rotary kiln for directing the hot product from the kiln to the rotary cooler.

25. The rotary kiln plant according to claim 24 wherein said rotary cooler communicates with the suspension preheater by a duct connected to a central cooler tube at said other end portion of said cocler and to a lower portion of said stationary combustion chamber.

* * * * *